US005305617A

United States Patent [19]

Fontana

[11] Patent Number: 5,305,617

[45] Date of Patent: Apr. 26, 1994

[54] CLOSING DEVICE FOR BRACELETS OF WATCHES, BRACELETS, JEWELS AND THE LIKE

[75] Inventor: Fernando Fontana, Sesto Calende, Italy

[73] Assignee: G.T.F. S.r.l., Sesto Calende, Italy

[21] Appl. No.: 925,436

[22] Filed: Aug. 11, 1992

[30] Foreign Application Priority Data

Sep. 6, 1991 [IT] Italy ..... MI91 U 000764

[51] Int. Cl.[5] ..... A44C 5/00

[52] U.S. Cl. ..... 63/3; 24/265 WS

[58] Field of Search ..... 63/3, 4, 5.1, 6, 7; 24/616, 598, 265 WS

[56] References Cited

U.S. PATENT DOCUMENTS

| | | | |
|---|---|---|---|
| 1,738,579 | 10/1929 | Heugas | 24/265 WS |
| 2,453,993 | 11/1948 | Kreisler | 24/265 WS |
| 3,376,619 | 4/1968 | Brunet | 24/265 WS |
| 3,404,440 | 10/1968 | Weiss | 24/265 WS |
| 3,478,537 | 11/1969 | Golberine et al. | 63/4 |
| 3,797,716 | 3/1974 | Mochizuki | 24/265 WS |
| 4,424,611 | 1/1984 | Mori | 24/265 WS |
| 4,545,094 | 10/1985 | Fontana | 24/265 WS |
| 4,546,522 | 10/1985 | Gygax | 24/265 WS |
| 4,675,955 | 6/1987 | Nakamura | 24/265 WS |
| 4,774,743 | 10/1988 | Ziemelis | 24/616 |

FOREIGN PATENT DOCUMENTS

| | | | |
|---|---|---|---|
| 350785 | 1/1990 | European Pat. Off. | 24/265 WS |
| 2600869 | 1/1988 | France | 24/265 WS |
| 668353 | 12/1988 | Switzerland | 24/265 WS |

*Primary Examiner*—Michael Milano
*Attorney, Agent, or Firm*—Bucknam and Archer

[57] ABSTRACT

To a branch (40) of a metal bracelet applicable to watches is fixed a frame (12) having a movable catch plate (20) and to which is hingedly connected an overturnable plate (14) having an end hook (34). Connected to the opposite branch of the bracelet is a forked member (16) having a tie bar (30) which fits into semicircular seats (26) formed in the frame (12) upon closure of the device. In another embodiment, the closing device includes two arched sheets (52) and (54), in sheet (54) a chamber (66) is formed in which slides a catch plate (76) the front end of which is coupled below the hook (52') formed at one end of sheet (52) upon closure of the device.

1 Claim, 4 Drawing Sheets

CLOSING DEVICE FOR BRACELETS OF WATCHES, BRACELETS, JEWELS AND THE LIKE

The present invention relates to a closing device for bracelets for watches, jewelry and the like. More particularly, the present invention relates to a closing device for bracelets adapted to efficiently close the opposite branches of the bracelet.

It is well known that a difference exists in the connecting and fixing systems of the branches forming a bracelet. A bracelet may include two separate edges which are connected by means of a buckle which is the case in leather or plastic wriststraps generally associated with inexpensive sports type watches.

Metal bracelets are, on the contrary, often provided with a closing device of the so-called type "with jointed portfolio", in which the branches of the bracelet are never definitely separated. The opening of the device creates, in fact, an elongation sufficient to remove the watch from the wrist. This system is definitely practical and safe, as it protects the watch from the risk of being dropped at the time of its positioning or removal from the wrist. Even an accidental opening of the device avoids this risk. The structure of the metal bracelet in question is therefore extremely strong, especially at the portfolio closing device with superposed edges. For this reason it is generally not made of valuable metal and applied to gold watches. For the latter, in particular those provided with metal bracelets of interwoven or barbed type, closing devices of limited size are preferred which traditionally provide a final separation of the branches of the bracelet. Such devices are not completely satisfactory since they do not protect the watch from the risk of being dropped in the abovementioned situations. The preliminary connection between the ends of the two branches to close the bracelet is also rather complicated and this difficulty often reappears at opening.

The primary object of the present invention is to solve the abovementioned problems, constructing a particularly reliable closing device suitable for application to metal bracelets of interwoven or barbed type. A further object of the present invention is to construct a closing device as defined above in which the movement of coupling in the closing phase and release in the opening phase takes place in a simple, rapid manner.

A final object of the present invention is to provide a closing device of easy, economic construction and of limited size.

These and other objects are achieved according to the present invention by a closing device to be used with metal bracelets for watches of interwoven or barbed type which basically includes a frame with a chamber in which a part is slidingly housed which forms the clip, and a plate, wherein the frame, connected with one branch of the bracelet, is substantially of horizontal "H" shape and has formed therein seats for the housing, in the closing phase of the device, of the tie bar of a fork shaped member hinged to the opposite branch of the bracelet.

Further characteristics and advantages of the present invention will be more clearly shown in the description which follows of a preferred, unbinding construction of the closing device; reference being had to the drawings, in which:

FIG. 1 a side view of the closing device;

Figure 1:
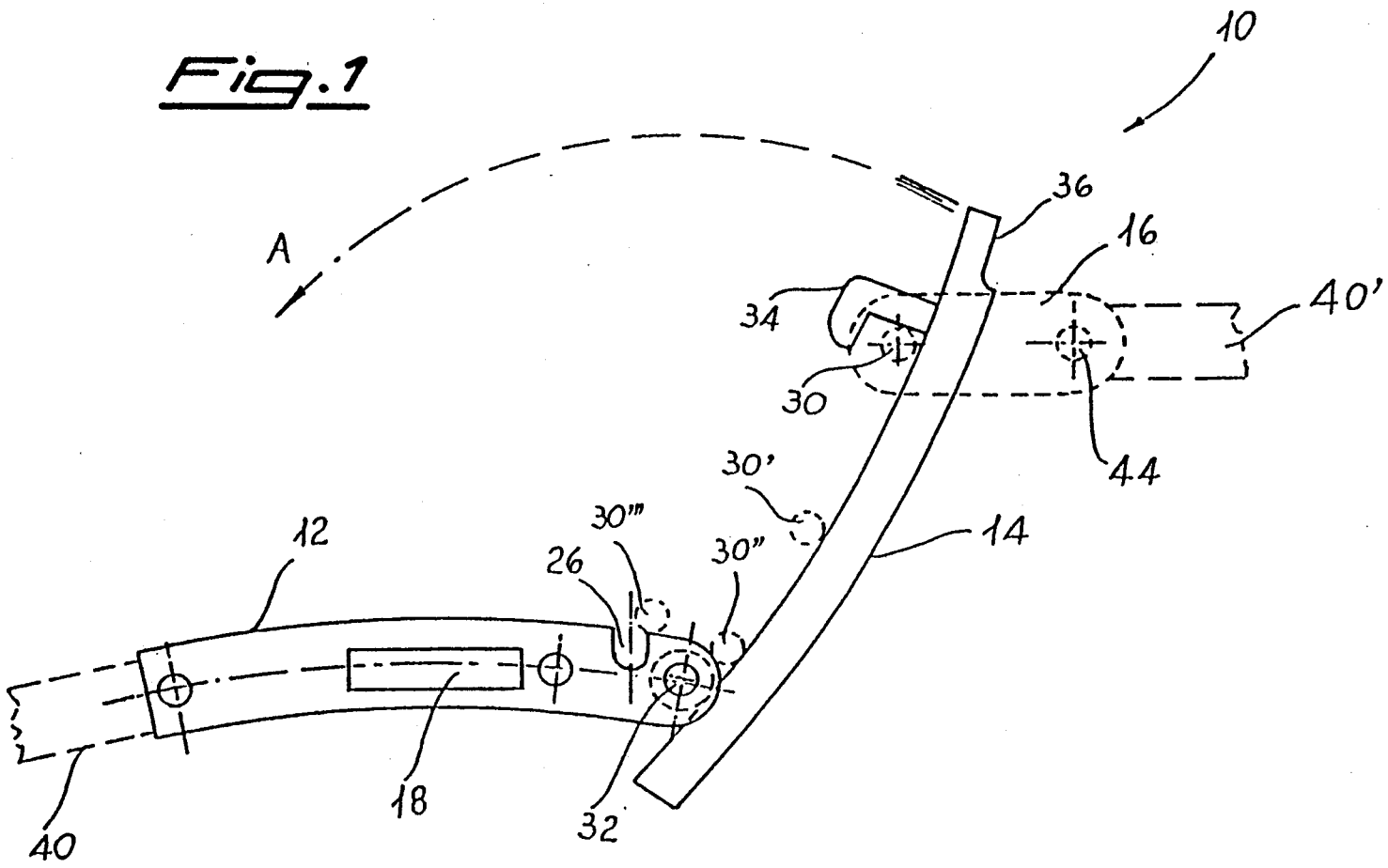
Figure 6:
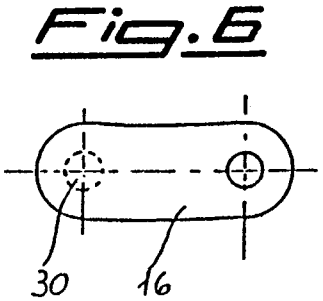
FIG. 6 is a side view of the fork member.
Figure 7:
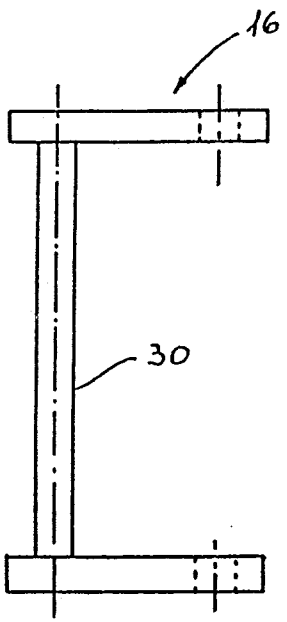
FIG. 7 is a plan view of the fork member shown in FIG. 6.

Now turning to the drawings, there is shown in FIG. 1 the closing device for metal watch bracelets, generally designated 10, consisting of a frame 12 connected with a branch of the bracelet schematically shown in phantom by the numeral 40, a plate 14 hingedly fixed to frame 12 and a fork shaped member 16 hingedly connected by pin 44 to the opposite branch of the bracelet, schematically shown in phantom by the numeral 40'.

In the substantially "H"-shaped frame 12 a parallelepiped chamber 18 is formed, adapted to slidingly house a catch plate 20 of rectangular shape. Plate 20 emerges from this chamber and forms the clip of the device, which is structurally and functionally the same as an earlier patent application filed by the same applicant and is therefore not described in detail herein.

The chamber 18 is bordered, on the end facing the plate 14, by a tie bar 22 with end pins 24 which are inserted in corresponding seats formed on the initial portion of the rear branches 28' of the "H"-shaped frame 12. Within chamber 18 elastic members are arranged, for example in the form of springs (not shown), which bias catch plate 20 outwards at the end of chamber 18 opposite the tie bar 22 and permits plate 20 to temporarily move back in the opening or closing phase of the device.

A pair of side plates 42, of substantially parallelepiped shape, are positioned parallel to each other adjacent the lateral branches of the "H"-shaped frame 12; each side plate is fixed, with screws or the like, to the side faces of the catch plate 20 housed in chamber 18. The side plates 42 prevent the plate 20 from moving laterally out of chamber 18 and at the same time make it possible to move plate 20 against the bias of the elastic members during the opening phase of the device.

On the frame 12, positioned near the end on which the plate 14 is fixed, a substantially semicircular seat 26 is formed, for example by milling both rear branches 28 and 28' of the "H"-shaped frame. Tie bar 30 of the fork shaped member 16 is housed in this seat 26 when the device 10 is in the closed position.

Figure 4:
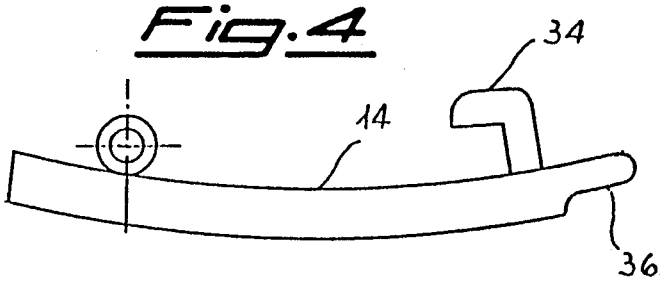
FIG. 4 is a side view of the plate having the end hook.
Figure 5:
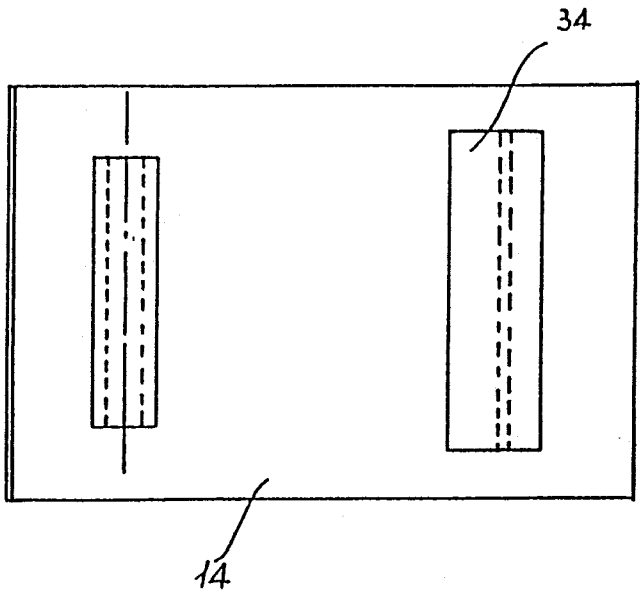
FIG. 5 is a plan view of the plate shown in FIG. 4.
Figure 2:
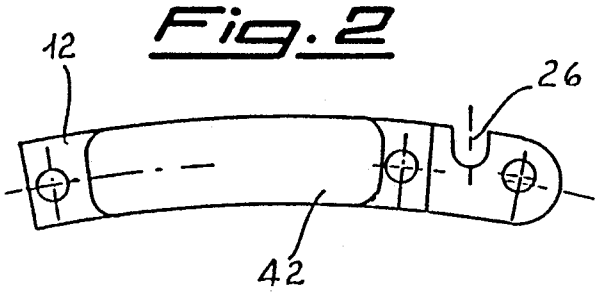
FIG. 2 is a side view of the frame with side plates.
Figure 3:
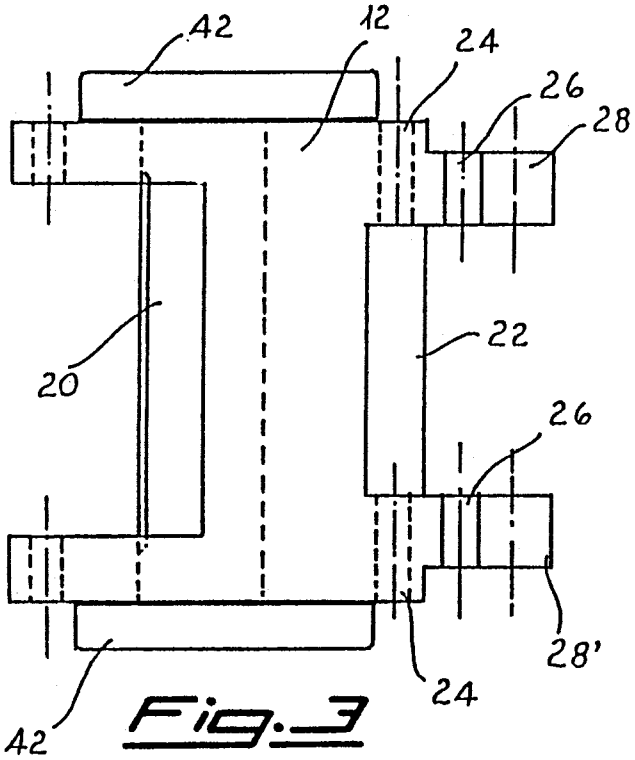
FIG. 3 is a plan view of the frame shown in FIG. 2.

The plate 14, hinged with pin 32 to the frame 12, is provided on the inside surface at its front end with an "L"-shaped hook 34, with bevelled end, shown in detail in FIGS. 1, 4 and 5 by way of example as regards conformation and size. Plate 14 is provided, on the outside surface at its front end and near the abovementioned hook 34, with a bevel 36 which thins this end of plate 14.

The operation of the closing device 10 will be described with reference in particular to FIG. 1 where the device is schematically shown in the open position. To the opposite branches 40 and 40' of the bracelet are respectively fixed the frame 12 with relevant plate 14 fitted with hook 34 and the fork shaped member 16. Fork 16 is preliminarily fitted on the plate 14 so that the tie bar 30 is placed below and in engagement with the abovementioned hook 34. The weight of the bracelet and watch tends to keep tie bar 30 in contact with the plate 14 as plate 14 is moved in the direction of arrow "A". As plate 14 is moved in the direction indicated by arrow "A", the tie bar 30 slides progressively on the inside wall or surface of plate 14, with 30', 30'' and 30''', being positions which the tie bar takes up before reaching the seats 26, formed on the rear branches of the "H"-shaped frame, and settling therein.

At this point the plate 14, under the effect of a light manual pressure, may drop completely with the chamfered hook 34 causing catch plate 20 arranged in the chamber 18 to move back temporarily, overcoming the resistence of the springs which keep it exposed, and thus closing the device. The chamfer 36, formed on the plate 14, connects the front end of same with the branch 40 of the bracelet.

The opening operation of the device is equally simple and rapid and may be performed without the risk of involuntary final separation of the branches 40 and 40' of the bracelet. Acting on the side plates 42 projecting from the frame 12, in the direction of the tie bar 22, the catch plate 20 which engages the hook 34 is temporarily disengaged therefrom so that hook 34 is therefore free to rise, following backwardly the route indicated by arrow "A".

The tie bar 30 of the fork 16, in the travel of this opening phase, remains systematically in contact with the inside surface of the plate 14 under the weight of the branch 40 and/or 40' of the bracelet and inevitably stops its travel, resting below the hook 34. This avoids the risk of involuntary separation of the abovementioned branches of the bracelet and consequently of the watch accidentally falling to the ground. Only the voluntary disengagement of the fork 16 from the hook 34 permits the separation of the branches 40 and 40' of the bracelet.

Figure 8:
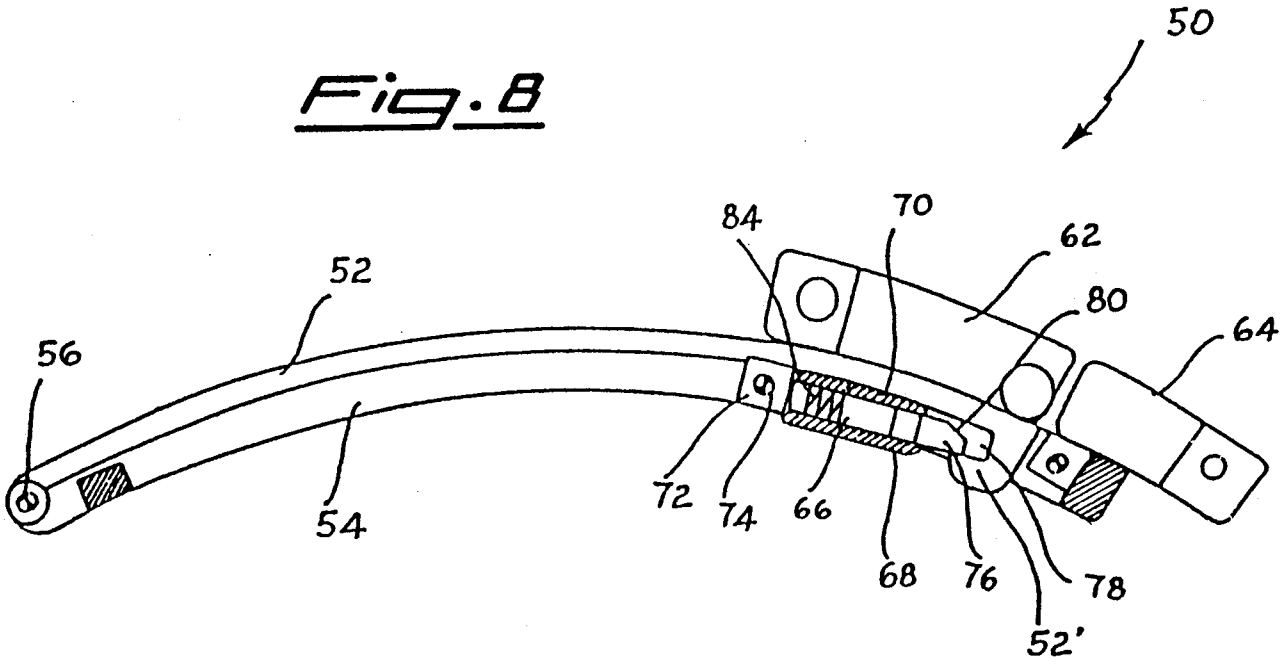
FIG. 8 is a partial sectional side view of a closing device according to an alternative embodiment.
Figure 9:
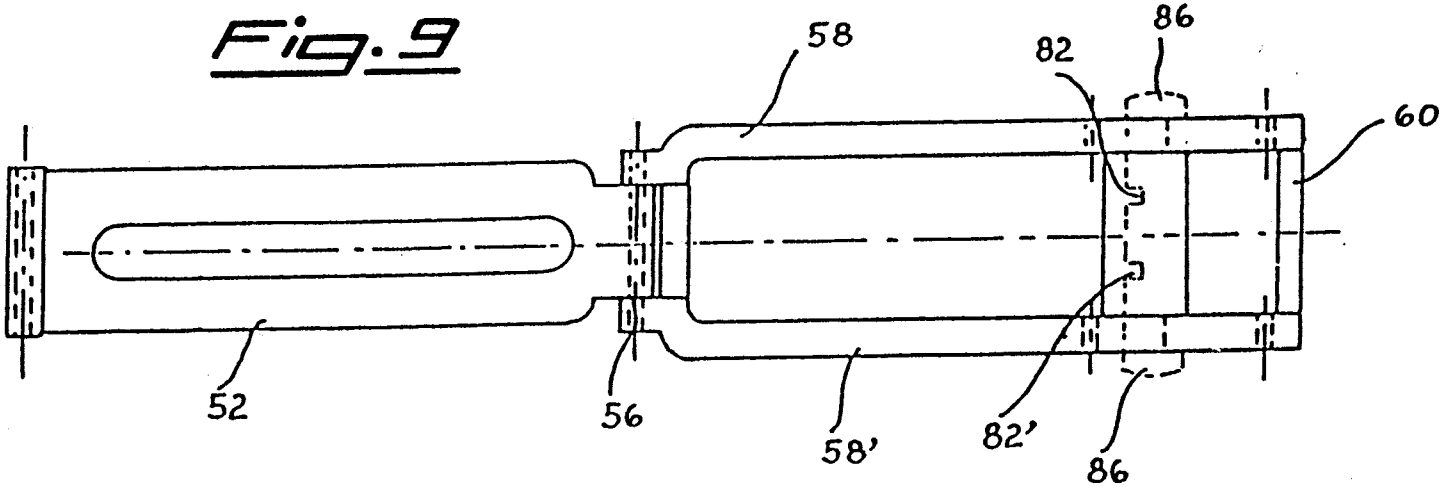
FIG. 9 is a plan view of the device of FIG. 8 shown in the open position.
Figure 10:
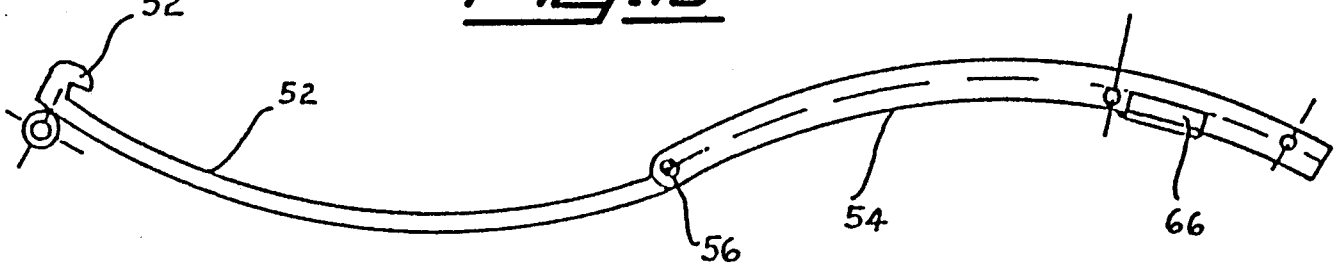
FIG. 10 is a side view of the device of FIGS. 8 and 9 shown in the open position.

FIGS. 8, 9 and 10 refer to another embodiment of the closing device for bracelets for watches, jewelry and the like. In these figures, the closing device, indicated generally by the numeral 50, basically consists of a pair of arched sheets 52 and 54 which adapt themselves anatomically to the wrist. These sheets are hinged together with generic pin 56 and are of slightly different thickness. Sheet 54 presents a greater thickness than the complementary sheet 52 and has a fork-like construction, with lateral branches 58, 58' and crosspiece 60 at its front end. At the top of these sheets are fixed the elements 62 and 64, respectively, which form the connecting base with each of the branches of the bracelet (not shown).

On sheet 54, near the end opposite that which connects it with the sheet 52, a chamber 66 is formed, adapted to contain the movable coupling member which closes the device. This chamber 66 is formed by transversally connecting the arms 58 and 58' of the sheet 54 by means of lower plate 68 and upper plate 70. The chamber 66, which is open at the front, is closed at the back by a tie bar 72 which forms its back wall and is fixed, with pin 74, to the abovementioned arms. On its lateral sides, the chamber 66 is open, due to the millings created in the thickness of the branches 58 and 58' of the sheet 54. The lower plate 68 is fixed, preferably by welding, to the arms 58 and 58' of the sheet 54 at the millings created on them and is faced by the upper plate 70. Upper plate 70 may be fixed by welding to the arms 58 and 58' of the sheet 54, or may be formed by thinning the thickness of this sheet. The chamber 66 thus formed presents, as internal span, a height preferably corresponding to that of the millings created on the arms 58 and 58'. On the interior of chamber 66 is slidingly arranged along surfaces free from roughness a catch plate 76 which forms the clip of the device, adapted to be engaged in the end seat 78 formed by end hook 52' on the sheet 52, as described hereinafter.

This catch plate 76, of substantially parallelepiped shape with front chamfer 80, is dimensioned so as to be precisely inserted in the chamber 66 through one or the other of the millings formed on the arms 58, 58' of the sheet 54 and to project therefrom laterally at both sides as designated by numerals 86 in FIG. 9. At the rear end of the catch plate 76 are formed two paired millings 82, 82' which form the seat for corresponding thrust springs 84, inserted in the chamber 66 through the rear. The latter is subsequently reclosed by the tie bar 72, formed by pin 74 engaging with the arms 58 and 58'.

After forming the chamber 66 as defined above by the presence of the plates 68 and 70, the assembly phase of the closing device is accomplished by:

a) the insertion in the chamber 66, through one of the millings created in the arms 58 and 58', of the plate 76;

b) the insertion in the same chamber, through the rear of the spring/springs 84 which contact the seats formed by the millings 82 and 82' on plate 76;

c) the positioning of the tie bar 72 so as to close the rear of the chamber 66 and the fixing of same with the pin 74 to the arms 58 and 58'.

After assembly, the catch plate 76 projects both laterally, from the millings obtained on the arms 58, 58', and frontally, due to the spring/springs 84.

To close the device it is sufficient to act on the sheet 52 causing it to rotate; the end hook 52' formed thereon comes into contact with the catch plate 76, in particular with the chamfered portion 80 with invitation for coupling.

A limited pressure exerted on this sheet forces the plate 76 to temporarily move back overcoming the bias of the springs 84.

Springs 84, when coupling has taken place, bias catch plate 76 towards end hook 52', locking the device.

The opening of the latter is accomplished easily and rapidly by acting on the plate 76 through the portions 86 laterally projecting from the chamber 66. As may be noted from the above, the multiple advantages of the invention are evident.

In both proposed forms of construction, the closing device is particularly functional and effective as regards locking and is suitable for closing or opening with a single rapid, simple movement.

The invention, as described and hereafter claimed, is, however, proposed purely as example, with the understanding that it may be subject to numerous modifications and variants, all however forming part of the inventive concept.

I claim:

1. A closing device for interwoven or barbed type metal bracelets, comprising:

a first arched sheet including first and second substantially longitudinally extending arms;

a second arched sheet complementary to said first arched sheet, said first and second sheets being hingedly connected together at one end thereof;

a chamber formed in said first sheet proximate the end thereof opposite the end connected to said second sheet, said chamber being formed by opposing plates connected at the top and bottom to said first and second arms;

a movable catch plate housed in said chamber and having lateral projections extending through millings formed in said arms beyond lateral sides of said first sheet, said catch plate including at least one seat for at least one spring housed in said chamber;

a tie bar closing said chamber at the end thereof proximate the end of said first sheet hingedly connected to said second sheet; and a hook disposed on said second sheet proximate an end opposite the connection to said first sheet, said hook defining a seat wherein the end portion of said catch plate, having a chamfer thereon, is engageable.

* * * * *